US006821147B1

(12) United States Patent
Hall et al.

(10) Patent No.: US 6,821,147 B1
(45) Date of Patent: Nov. 23, 2004

(54) INTERNAL COAXIAL CABLE SEAL SYSTEM

(75) Inventors: David R. Hall, Provo, UT (US); H. Tracy Hall, Jr., Provo, UT (US); David Pixton, Lehi, UT (US); Scott Dahlgren, Provo, UT (US); Cameron Sneddon, Provo, UT (US); Michael Briscoe, Lehi, UT (US); Joe Fox, Spanish Fork, UT (US)

(73) Assignee: Intelliserv, Inc., Provo, UT (US)

( * ) Notice: Subject to any disclaimer, the term of this patent is extended or adjusted under 35 U.S.C. 154(b) by 0 days.

(21) Appl. No.: 10/640,956

(22) Filed: Aug. 14, 2003

(51) Int. Cl.[7] ..... H01R 9/05
(52) U.S. Cl. ..... 439/581; 439/578
(58) Field of Search ..... 439/581, 578–580, 439/582–584; 174/28, 50.55, 99

(56) References Cited

U.S. PATENT DOCUMENTS 3,489,988 A * 1/1970 Carnaghan ..... 439/274
4,238,974 A * 12/1980 Fawcett ..... 74/502.5
4,971,569 A * 11/1990 Gooch et al. ..... 439/188
5,192,414 A * 3/1993 Indig et al. ..... 204/400
5,351,388 A * 10/1994 Van Den Berg et al. ... 29/602.1
6,168,455 B1 * 1/2001 Hussaini ..... 439/394
6,202,743 B1 * 3/2001 Moore ..... 166/65.1
6,309,250 B1 * 10/2001 Hyzin ..... 439/578

* cited by examiner

*Primary Examiner*—Michael C. Zarroli
(74) *Attorney, Agent, or Firm*—Cameron R. Sneddor

(57) ABSTRACT

The invention is a seal system for a coaxial cable more specifically an internal seal system placed within the coaxial cable and its constituent components. A series of seal stacks including flexible rigid rings and elastomeric rings are placed on load bearing members within the coaxial cable. The current invention is adapted to seal the annular space between the coaxial cable and an electrical contact passing there through. The coaxial cable is disposed within drilling components to transmit electrical signals between drilling components within a drill string. During oil and gas exploration, a drill string can see a range of pressures and temperatures thus resulting in multiple combinations of temperature and pressure and increasing the difficulty of creating a robust seal for all combinations. The seal system can be used in a plurality of downhole components, such as sections of pipe in a drill string, drill collars, heavy weight drill pipe, and jars.

36 Claims, 9 Drawing Sheets

INTERNAL COAXIAL CABLE SEAL SYSTEM

This invention was made with government support under Contract No, DE-FC26-97FT343656 awarded by the U.S. Department of Energy. The government has certain rights in the invention.

BACKGROUND

The present invention relates to the field of sealing systems, particularly internal seal systems for coaxial cables. The preferred seal systems are particularly well suited for use in difficult environments wherein it is desirable to seal inside a coaxial cable without the normal means available such as o-rings in machined grooves, metal o-rings, or a split metallic ring. One such application is in data transmission systems for downhole environments, such as along a drill string used in oil and gas exploration or along the casings and other equipment used in oil and gas production.

The goal of accessing data from a drill string has been expressed for more than half a century. As exploration and drilling technology has improved, this goal has become more important in the industry for successful oil, gas, and geothermal well exploration and production. For example, to take advantage of the several advances in the design of various tools and techniques for oil and gas exploration, it would be beneficial to have real time data such as temperature, pressure, inclination, salinity, etc. Several attempts have been made to devise a successful system for accessing such drill string data. One such system is disclosed in co-pending U.S. application Ser. No. 09/909,469 (also published as PCT Application WO 02/06716) which is assigned to the same assignee as the present invention. The disclosure of this U.S. application Ser. No. 09/909,469 is incorporated herein by reference. Another such system is disclosed in co-pending U.S. application Ser. No. 10/358,099 the title of which is DATA TRANSMISSON SYSTEM FOR A DOWNHOLE COMPONENT file on Feb. 3, 2003. The disclosure of this U.S. application Ser. No. 10/358,099 is herein incorporated by reference.

Downhole data transmission systems use seals to protect the electrical transmission line from the drilling environment such as the system described above. Drilling fluids such as drilling mud are pumped down the center of a drilling tool for many purposes such as to flush out cuttings on the bottom of the borehole. Drilling fluids are often corrosive which increases the difficulty of making a successful seal. A borehole created by drilling can have various temperature and pressure ranges as the depth of the borehole increases. Due to the large range and subsequent combinations of temperatures and pressures along the depth of the borehole, a robust seal design is necessary to protect the electrical transmission line of a data transmission system.

SUMMARY

Briefly stated, the invention is a sealing system used to seal within an electrical transmission line particularly a coaxial cable. Another aspect of the invention is a system for sealing an electrical transmission line within a string of downhole components.

In accordance with one aspect of the invention, the system includes a plurality of downhole components, such as sections of pipe in a drill string. Each component has a first and second end, with a first communication element located at the first end and a second communication element located at the second end. Each communication element includes a first contact and a second contact. The system also includes a coaxial cable running between the first and second communication elements, the coaxial cable having a conductive tube and a conductive core within it. The system also includes a first and second connector for connecting the first and second communication elements respectively to the coaxial cable. Each connector includes a conductive sleeve, lying concentrically within the conductive tube, which fits around and makes electrical contact with the conductive core. The conductive sleeve is electrically isolated from the conductive tube. The conductive sleeve of the first connector is in electrical contact with the first contact of the first communication element, the conductive sleeve of the second connector is in electrical contact with the first contact of the second communication element, and the conductive tube is in electrical contact with both the second contact of the first communication element and the second contact of the second communication element.

In accordance with another aspect of the invention, the drill components are sections of drill pipe, each having a central bore, and the first and second communication elements are located in a first and second recess respectively at each end of the drill pipe. The system further includes a first passage passing between the first recess and the central bore and a second passage passing between the second recess and the central bore. The first and second connectors are located in the first and second passages respectively. Preferably, each section of drill pipe has a portion with an increased wall thickness at both the box end and the pin end with a resultant smaller diameter of the central bore at the box end and pin end, and the first and second passages run through the portions with an increased wall thickness and generally parallel to the longitudinal axis of the drill pipe. The box end and pin end is also sometimes referred to as the box end tool joint and pin end tool joint.

In accordance with another aspect of the invention, the components are sections of drill pipe, drill collars, jars, and similar components that would be typically found in a drill string.

In accordance with another aspect of the invention, the system includes a coaxial cable with a conductive tube and core within it, a base component that is placed within the conductive tube, a washer, and a seal stack placed on top of the washer. The seal stack is formed from a combination of an elastomeric component and a flexible rigid component, a detailed description of which will be found below. Each of these components is placed within the conductive tube with the elastomeric component of the seal stack in a compressive state. The contact extending from the communications element goes through the center portion of these components thus forming a seal between the contact and the internal diameter of the conductive tube.

In accordance with another aspect of the invention, the method includes placing a seal within a coaxial cable with an electrical lead passing through the seal.

In accordance with another aspect of the invention, the method includes placing a base component inside the conductive tube of the coaxial cable. The base component includes a means to mechanically engage the internal diameter of the conductive tube thus holding the base component in place. The method also includes a washer and seal stack are then placed inside the conductive tube with the washer lying on top of the base component and the seal stack on top of the washer. The method further includes a contact, which is pushed through the central portion of the seal stack, the washer, and the base component to an electrical connector placed beyond the base component thus making electrical communication with the coaxial cable. If necessary the contact passes through a tubular spacer which then forces the seal stack within the conductive tube as the contact is pushed through each of the components.

The present invention, together with attendant objects and advantages, will be best understood with reference to the detailed description below in connection with the attached drawings.

DETAILED DESCRIPTION OF THE PRESENTLY PREFERRED EMBODIMENTS

It should be noted that, as used herein, the term "downhole" is intended to have a relatively broad meaning, including such environments as drilling in oil and gas, and geothermal exploration, the systems of casings and other equipment used in oil, gas and geothermal production.

It should also be noted that the term "transmission" as used in connection with the phrase data transmission or the like, is intended to have a relatively broad meaning, referring to the passage of signals in at least one direction from one point to another.

Figure 1:
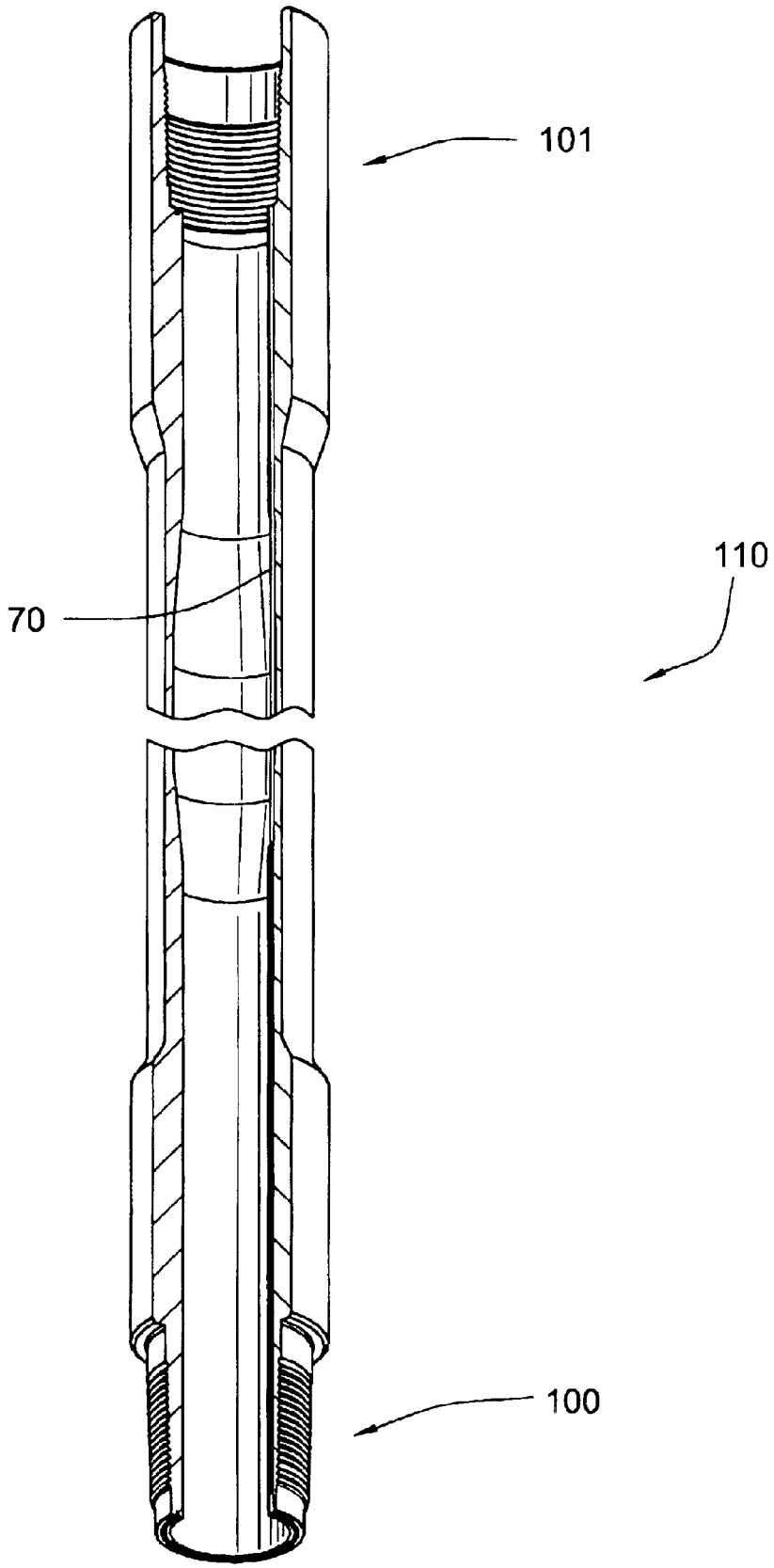
FIG. 1 is a partial cross sectional view of a drill pipe including a box end tool joint and pin end tool joint.

Referring to the drawings, FIG. 1 is a partial cross sectional view of a drill pipe 110 including a box end tool joint 101 and pin end tool joint 100. A coaxial cable 70 is disposed within the drill pipe running along the longitudinal axis of the drill pipe 110. The coaxial cable includes a conductive tube and a conductive core within it, which will be evident from the other drawings of the invention. In a preferred embodiment the drill pipe will include tool joints as depicted in FIG. 1 however, a drill pipe without a tool joint can also be modified to house a coaxial cable and thus tool joints are not necessary for the invention. The coaxial cable could be disposed in other downhole tools such drill collars, jars; and similar components that would be typically found in a drill string. Additionally the coaxial cable could be disposed within other downhole components used in oil and gas or geothermal exploration through which it would be advantageous to transmit an electrical signal and thus require a seal.

Between the pin end 100 and box end 101 is the body of the section. A typical length of the body is between 30 and 90 feet. Drill strings in oil and gas production can extend as long as 20,000 feet, which means that as many as 700 sections of drill pipe and downhole tools can be used in the drill string.

The conductive tube is preferably made of metal, more preferably a strong metal, most preferably steel. By "strong metal" it is meant that the metal is relatively resistant to deformation in its normal use state. The metal is preferably stainless steel, most preferably 316 or 316L stainless steel. A preferred supplier of stainless steel is Plymouth Tube, Salisbury, Md.

In an alternative embodiment, the conductive tube may be insulated from the pipe in order to prevent possible galvanic corrosion. At present, the preferred material with which to insulate the conductive tube is PEEK®.

Figure 2:
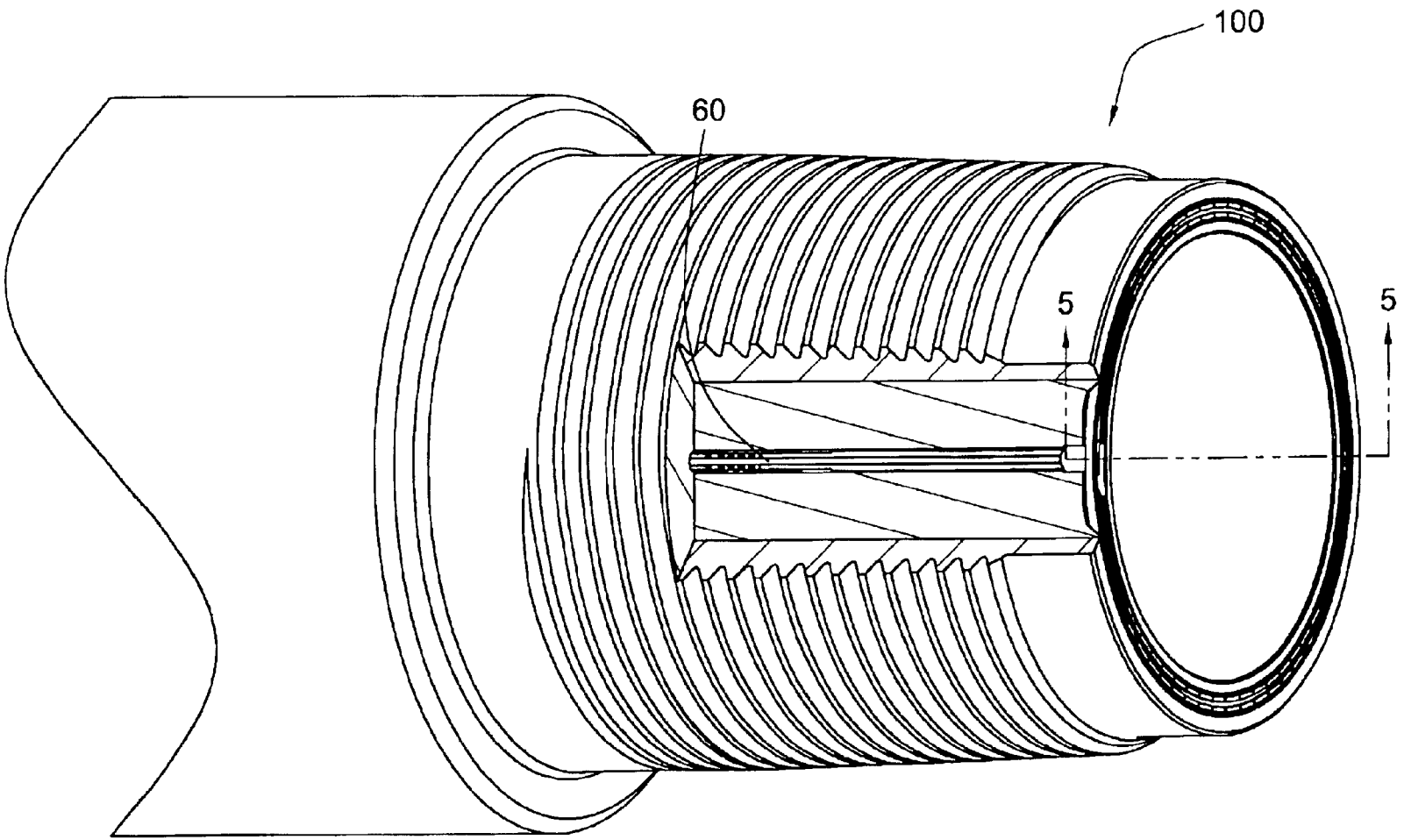
FIG. 2 is a dose up of a partial cross sectional view of the pin end of FIG. 1.

FIG. 2 shows a close up of the pin end 100 of the drill pipe 110 in FIG. 1. A partial cross section of the pin end 100 shows the placement of the coaxial cable and the seal system of the present invention. A communications element is disposed within the pin end 100. A contact 60 is shown passing from the communications element to a connector within the coaxial cable the detail of which will be shown in the remaining figures.

Figure 3:
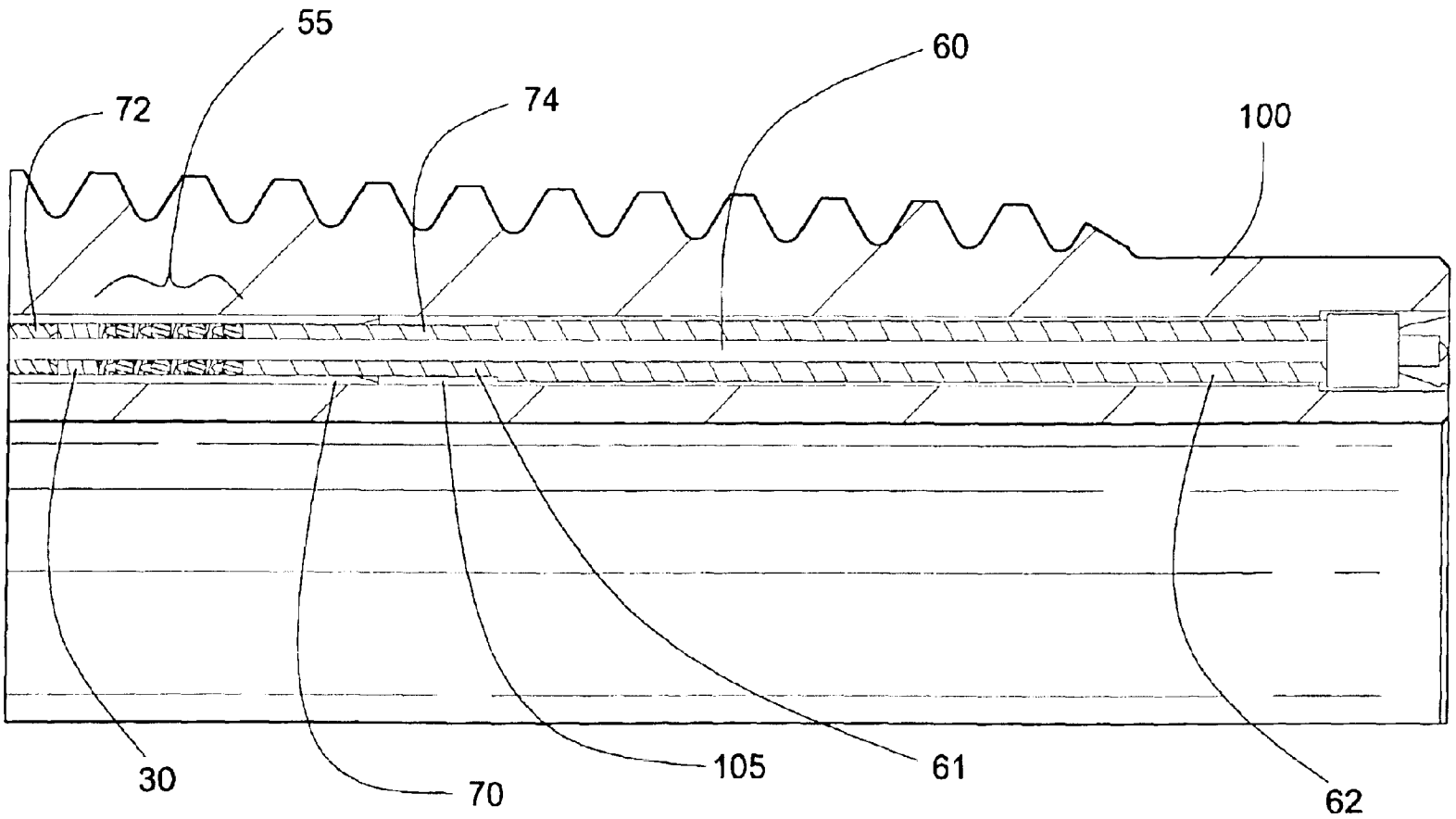
FIG. 3 is a cross sectional view of the pin end tool joint along the lines 5—5 of FIG. 2.

With reference now to FIG. 3 of the present invention which is a cross sectional view of the pin end 100 along lines 5—5 in FIG. 2, the placement of the seal system will be described. The pin end 100 includes a bore 105 within the pin end annular wall for placing the coaxial cable 70. An annular base component 72 is disposed within the coaxial cable 70, which includes a conductive tube and conductive core within it. The base component includes a means for engaging the inner surface of the conductive tube of coaxial cable 70 such as barbs or teeth. A washer 30 rests on the annular base component 72.

The washer is preferably constructed of a stiff material such as ceramics, plastics, or garolite, a grade of fiberglass. The ceramics could be cemented tungsten carbide, alumina, silicon carbide, silicone nitride, and polycrystalline diamond. The plastics are preferably made of a thermoplastic material such as polyether ether ketone or polyether ketone ketone. Other alternative materials include fiber reinforced composite materials, polyamide, electrically insulated metal, or other suitable material having high temperature resistance and high sheer strength in order to maintain its shape without significant creeping under high temperatures and pressures. Another example of which is fiberglass such as garolite.

A seal stack 55 comprising flexible rigid components and elastomeric components is placed on top of the washer 30 and adapted to seal the annular space between the inside surface of the conductive tube of coaxial cable 70 and the contact 60. A flexible rigid component is placed first on the washer 30 as part of the seal stack. A contact 60 passes through the seal stack 55, washer 30, and annular base component 72 resulting in electrical communication between the communications element and the coaxial cable. It may be necessary to use a tubular spacer 74 to dispose the seal stack 55 and other elements within the coaxial cable 70. To do this the tubular spacer 74 would have a first and second end. The first end 61 has a smaller diameter than the internal diameter of the conductive tube of coaxial cable 70 allowing it to be inserted into the conductive tube and thus forcing the seal stack 55 on top of the washer 30. The second end 62 can have a larger diameter than first end 61 though not integral to its functionality.

Figure 4:
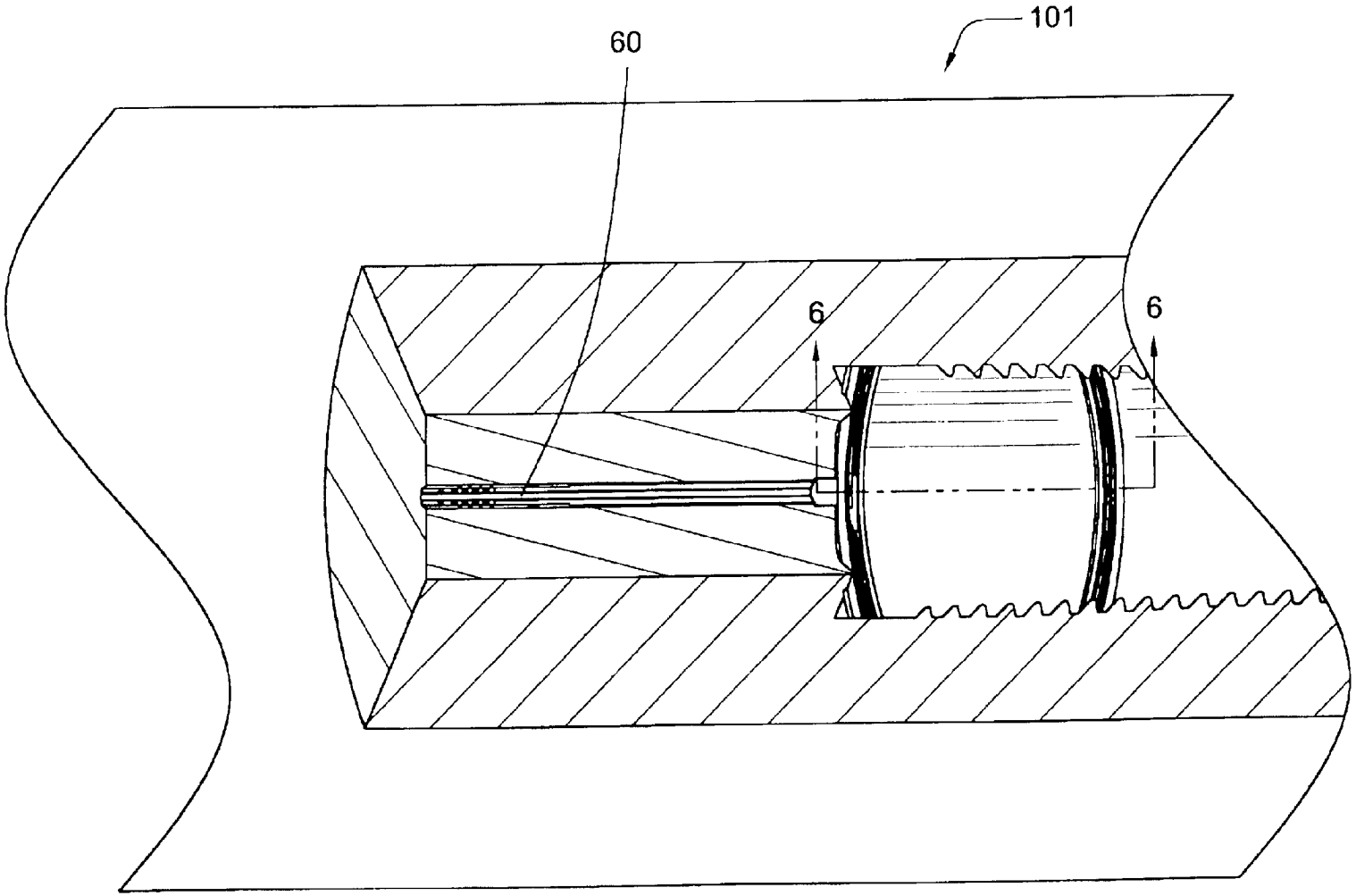
FIG. 4 is a close up of a partial cross sectional view of the box end of FIG. 1.
Figure 5:
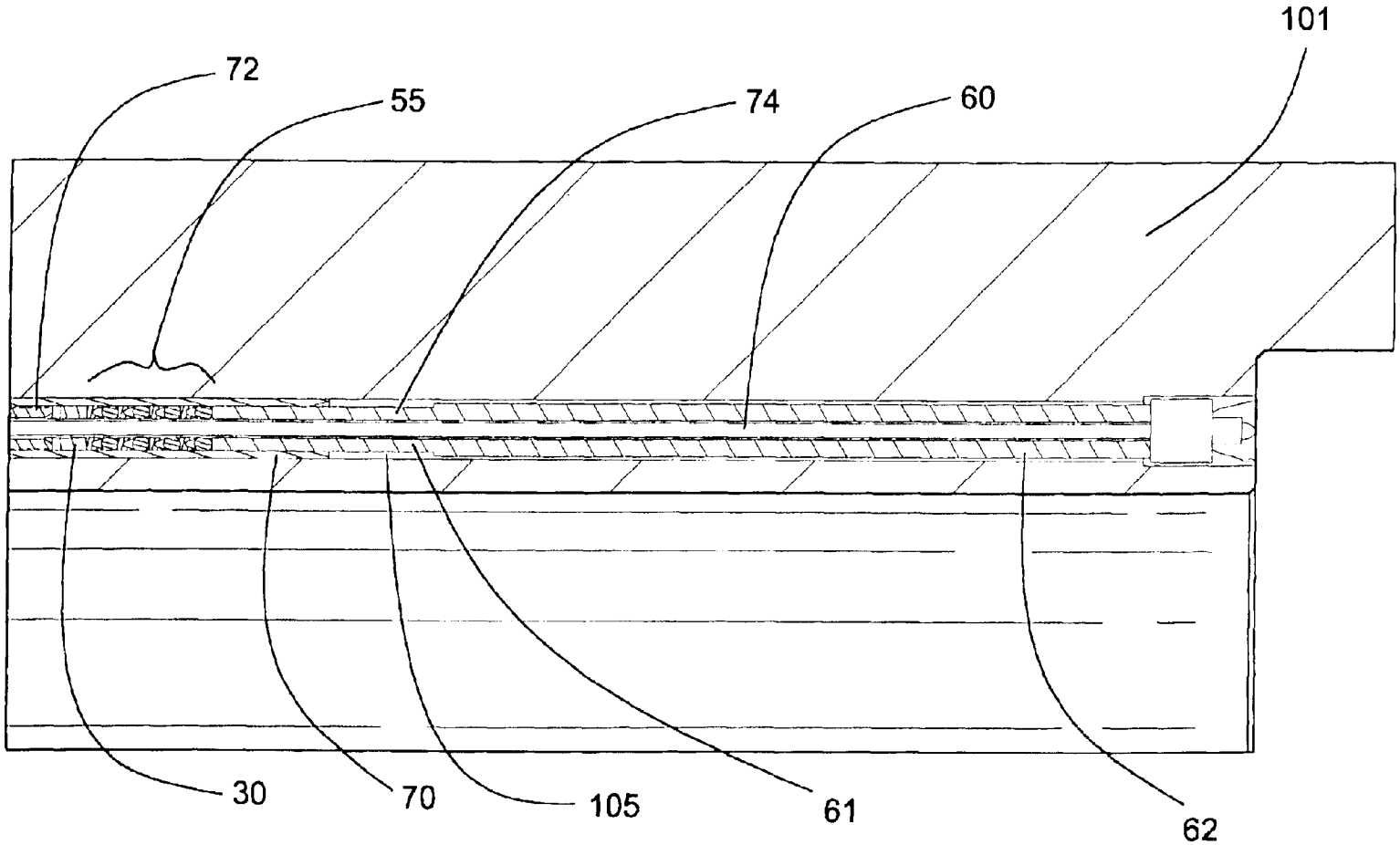
FIG. 5 is a cross sectional view of the pin end tool joint along the lines 6—6 of FIG. 4.

FIGS. 4 and 5 depict the box end tool joint 101 of drill pipe 110 in FIG. 1. FIG. 4 shows a partial cross section of the box end tool joint 101 including the placement of the coaxial cable and the seal system of the present invention. A communications element is disposed within the box end 101. A contact 60 is shown passing from the communications element to a connector within the coaxial cable the detail of which will be shown in the remaining figures.

Turning now to FIG. 5 of the present invention which is a cross sectional view of the box end 101 along lines 6—6 in FIG. 4, the placement of the seal system will be described. The box end 101 includes a bore 105 within the pin end annular wall for placing the coaxial cable 70. An annular base component 72 is disposed within the coaxial cable 70, which includes a conductive tube and conductive core within it. The base component includes a means for engaging the inner surface of the conductive tube of coaxial cable 70 such as barbs or teeth. A washer 30 rests on the annular base component 72. Both the base component 72 and washer 30 are load-bearing bodies needed under the extreme environment of high temperature and high pressure to help prevent the seal stack 55 from extruding. It is understood that high temperature is preferably above 300° F. and high pressure is preferably above 10,000 psi.

A seal stack 55 comprising flexible rigid components and elastomeric components is placed on top of the washer 30 and adapted to seal the annular space between the inside surface of the conductive tube of coaxial cable 70 and the contact 60. A flexible rigid component is placed first on the washer 30 as part of the seal stack. A contact 60 passes through the seal stack 55, washer 30, and annular base component 72 creating electrical communication between the communications element and the coaxial cable. It may be necessary to use a tubular spacer 74 to dispose the seal stack 55 and other elements within the coaxial cable 70. To do this the tubular spacer 74 would have a first and second end. The first end 61 has a smaller diameter than the internal diameter of the conductive tube of coaxial cable 70 allowing it to be inserted into the conductive tube and thus forcing the seal stack 55 on top of the washer 30. The second end 62 can have a larger diameter than first end 61 though not integral to its functionality though that is the case in the preferred embodiment.

Figure 6:
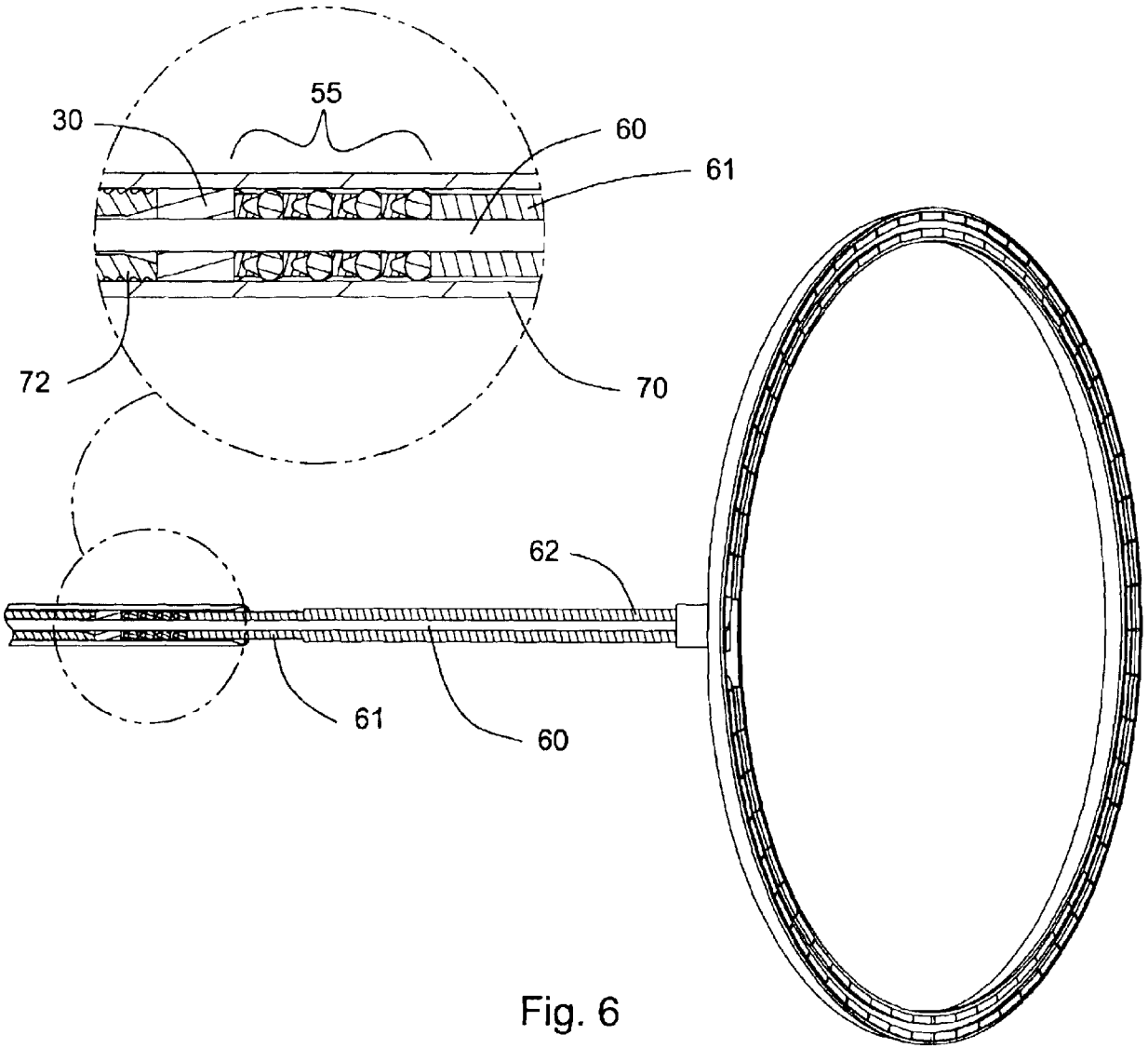
FIG. 6 is a partial cross-section of the coaxial cable including a close up view showing an embodiment of the invention.

Looking now at FIG. 6 we see the communications element and coaxial cable in plain view outside its setting of a drilling component. The contact 60 is shown passing from the communications element through the tubular spacer 74 including first and second ends 61, 62 respectively. A detailed close up of the seal stack and associated geometry is shown in the magnified circle view. The annular base component 72 including barbs for engaging the conductive tube internal surface is shown. The washer 30 is placed in between the seal stack 55 and the annular base component 72. Though this magnified view shows the basic geometry and shape of the seal stack a more detailed discussion of the discrete components comprising the seal stack 55 will follow.

The contact 60 is shown passing through the seal stack 55, washer 30, and annular base component 72 to a connector below (not shown). The first end 61 of the tubular spacer 74 abuts the seal stack 55 thus forcing the seal stack into the conductive tube of coaxial cable 70. The elastomeric components of seal stack 55 are in compression thus sealing the annular space between the conductive tube of coaxial cable 70 and the contact 60.

Figure 7:
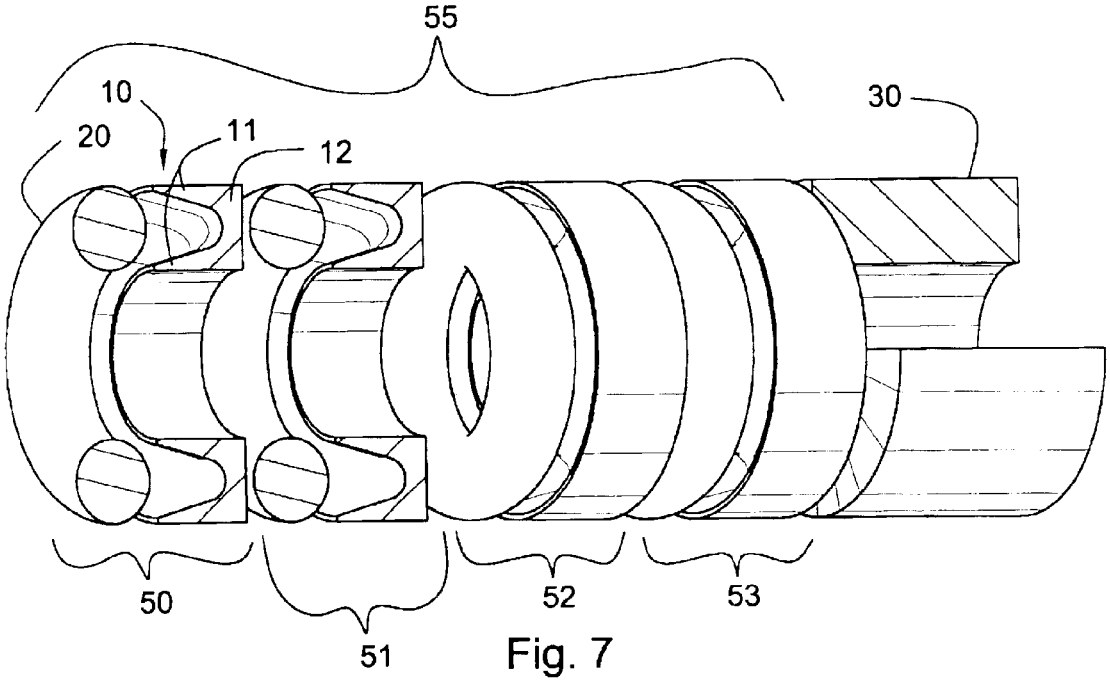
FIG. 7 is a close up view of a partial cross-section of a preferred embodiment of the invention.
Figure 8:
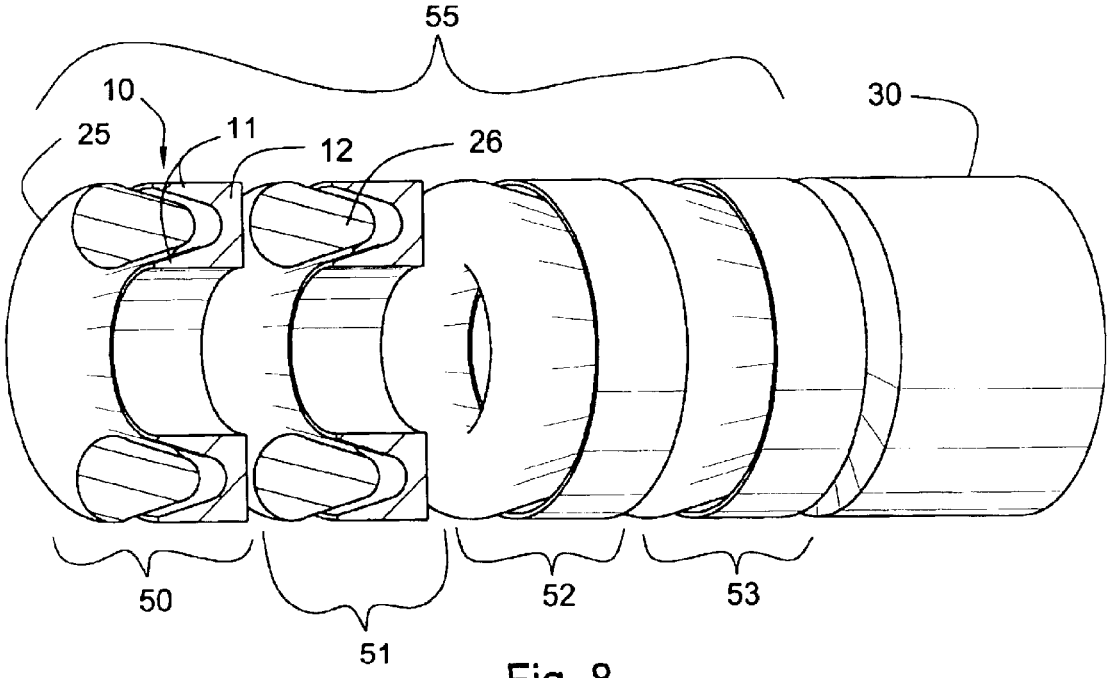
FIG. 8 is a close up view of a partial cross-section of another embodiment of the invention depicting a modified elastomer component.

With reference now to FIGS. 7 and 8 the seal stack components and resultant geometries will be described including varying embodiments of the invention wherein like parts are represented by like numerals. FIG. 7 is a preferred embodiment of the invention including the washer a plurality of seal stacks 55. As shown in the previous drawings in its most preferred embodiment the seal system will include a plurality of individual seal stacks 55 though one seal stack can be used. A first, second, third, and fourth seal stack 53, 52, 51, and 50 respectively are placed serially on top of each other within the conductive tube. We will now turn to the individual components of the seal stack.

The seal stack comprises a flexible rigid component 10 with a base 12 that is generally flat and arms 11 extending from the base. The extending arms 11 form a trough in the flexible rigid component 10. In this embodiment the shape of the trough is generally v-shape with a concave bottom surface. Though the term flexible rigid component is perhaps at first blush two conflicting terms, in this particular invention an enabling feature requires that this component be both rigid and flexible under differing conditions. More specifically the rigid component is an anti-extrusion ring under low-pressure conditions and a flexible sealing ring under high temperature and high-pressure conditions. The trough placed on one side of the flexible rigid ring endows it with its needed flexibility under periods of load.

An elastomeric component 20 is placed on each flexible rigid component 10 above the trough. The elastomeric component could be an elastomeric o-ring and is the most preferred form in the present invention. An alternative shape could be an x-ring sometimes referred to as a quad ring or a specialty ring forming a non-traditional shape such as one shown in FIG. 8. The integral feature of the seal stack requires that the volume of the elastomeric component is greater than the volume of the trough in the rigid component. The flexible rigid component prevents the elastomeric component from flowing and breaking its seal between the inner surface of the conductive tube and the contact, which may otherwise occur under high pressure and temperature conditions. A more detailed discussion of these features is found below.

Turning now to FIG. 8, which depicts and alternative embodiment of the invention, we see that the basic geometry of the washer 30 remains the same. However, the elastomeric component 25 of the seal stack 50 is shaped with one side 26 to mate with the trough of the flexible rigid component 10. The elastomeric component 25 could have an alternative shape on the one side 26 so long as it mates with the corresponding trough shape, alternative forms of which will be depicted in the other figures. The other basic elements of the seal system are the same including the washer 30 and a plurality of seal stacks 55 with elastomeric components 25 and flexible rigid components 10.

Figure 9:
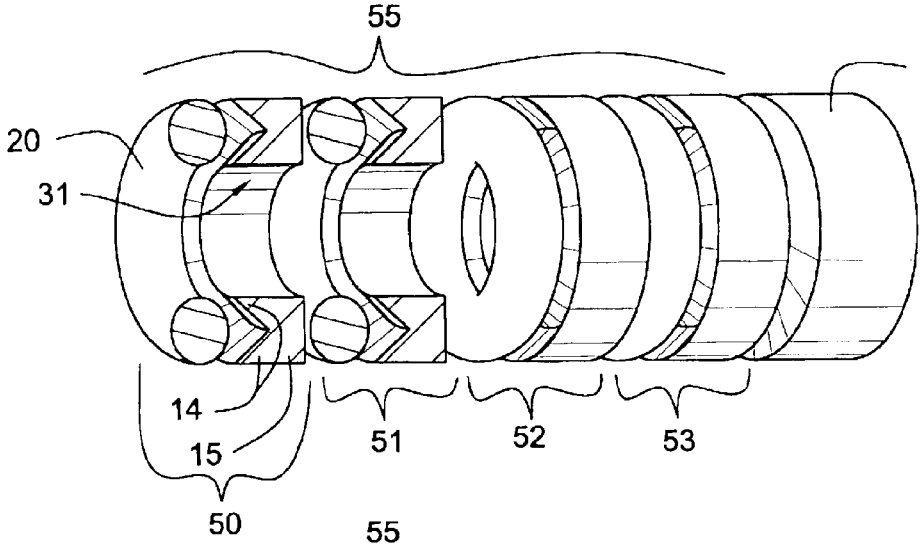
FIG. 9 is a dose up view of a partial cross-section of another embodiment of the invention showing an alternative flexible rigid component shape.

An alternative flexible rigid component is shown in FIG. 9. The flexible rigid component 31 includes a base 15 with extending arms 14. The extending arms 14 form a v-shape trough without the concave surface as shown in FIG. 7. This shape allows for a stiffer rigid component and reduced flexibility as deemed necessary for the application. In this embodiment the depth of the trough is less than half of the flexible rigid component overall height. In the previously discussed embodiments the depth of the trough is over half the height of the rigid component. Note still that the volume of the elastomeric ring 20 is greater than the volume of the v-shaped trough in rigid ring 31. The other members of the seal system including the washer 30 and the plurality of seal stacks 55 are the same.

Figure 10:
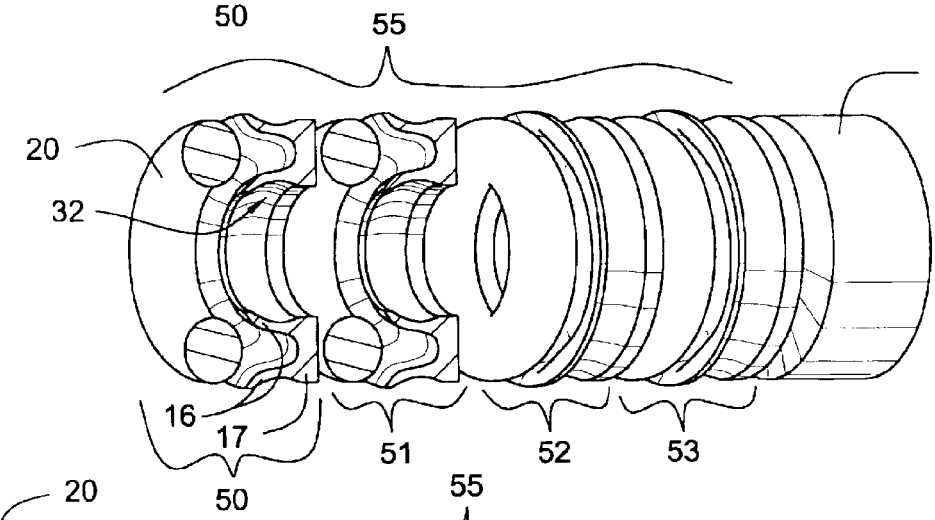
FIG. 10 is a close up view of a partial cross-section of another embodiment of the invention showing an alternative flexible rigid component shape.

FIG. 10 discloses another alternative shape for the flexible rigid component of the seal stack. The rigid component 32 of seal stacks 50, 51, 52, and 53 includes a base 17 with extending arms 16. The extending arms 16 form an arcuate sidewall. This feature gives the flexible rigid component more tractability as is deemed necessary for the application. The remaining elements of the seal system including the washer 30 and a plurality of seal stacks 55 placed serially on top of each other remain the same as previous embodiments.

Figure 11:
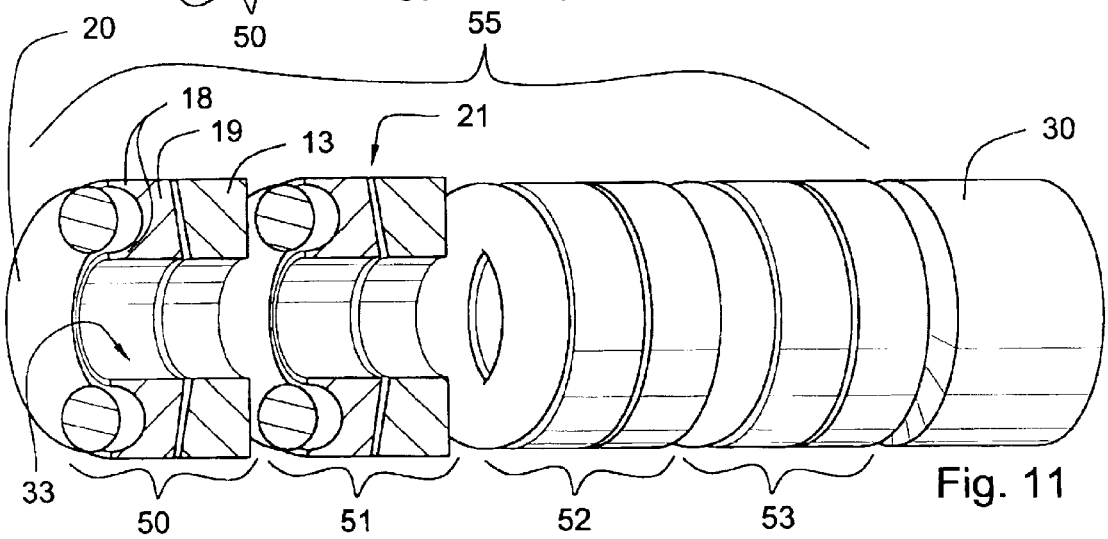
FIG. 11 is a close up view of a partial cross-section of another embodiment of the invention showing an two part flexible rigid component.

In FIG. 11 we depart even more from the various embodiments of the present invention, more particularly the shape of the flexible rigid component. In this embodiment the flexible rigid component is split into two parts a first and second rigid ring 13 and 33 respectively. The first ring 13 has a generally flat bottom surface and the topside forms a complimentary angle 21 with the base 19 of the second ring 33. The complimentary angle augments its strength to withstand the pressure load. The second ring 19 also includes arms 18 extending from the base 19. In this drawing the trough forms a half circle bottom. This is simply another example of the possible shape of the trough although the trough in this embodiment could include the other trough shapes of previously discussed flexible rigid component embodiments. The seal stack then includes a two part flexible rigid component 13, 33 and an elastomer ring 20. The plurality of seal stacks 55 lying serially on top of each other includes each component of the individual seal stacks 50, 51, 52, and 53. In one embodiment of the invention the first rigid ring is made of a thermoplastic material such as PEEK® or PEKK. PEEK® is a registered trademark of Victrex, PLC Corporation and is a trade name for the chemical compound polyether ether ketone. PEKK is an acronym for polyether ketone ketone; both PEEK® and PEKK are thermoplastic polymers which will be discussed in more detail below. The second rigid ring is preferably made of a Teflon material and most preferably of metal filled Teflon, such as Nickel loaded Teflon.

Figure 12:
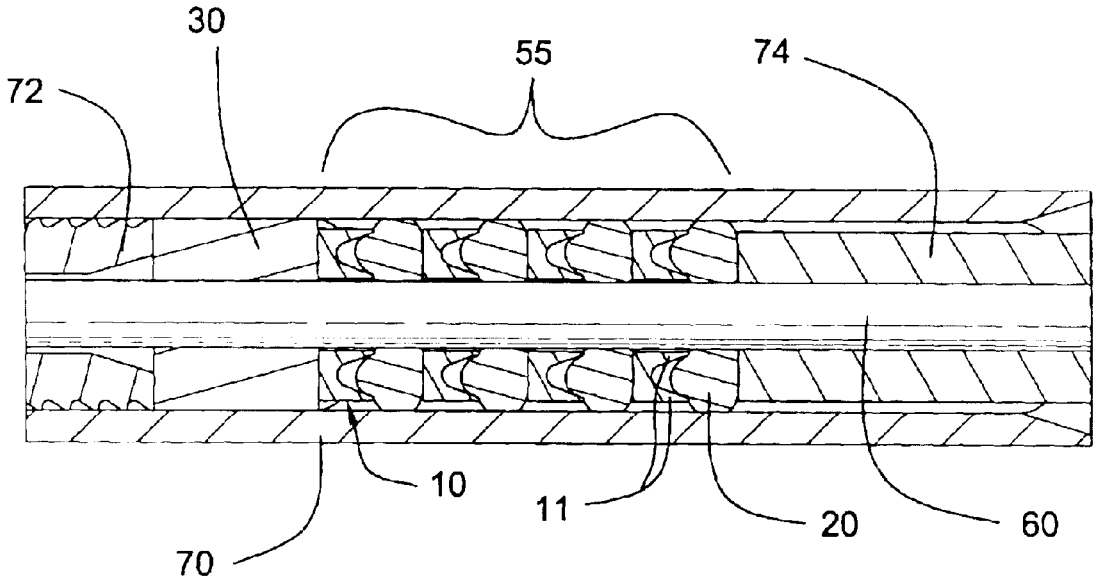
FIG. 12 is a dose up cross sectional view of the Invention under low pressure.
Figure 13:
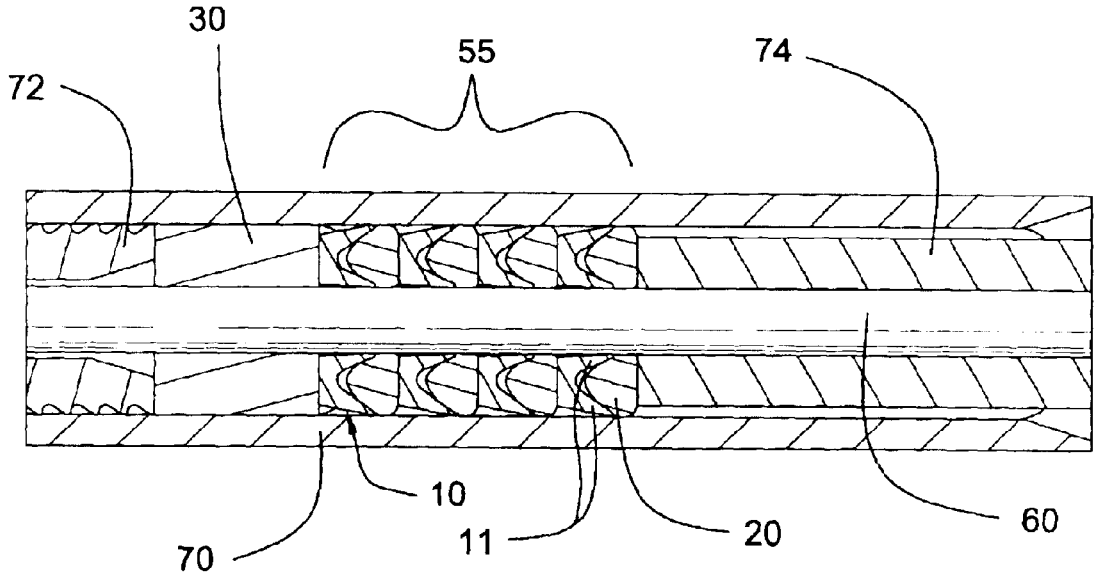
FIG. 13 is a close up cross sectional view of the invention under high pressure and high temperature conditions.

Turning to FIGS. 12 and 13 we see a depiction of the seal system under a low-pressure environment and a high pressure and high temperature environment respectively. The plurality of seal stacks 55 depicts the seal system embodiment as shown in FIG. 7. Under a low pressure environment as shown in FIG. 12, the elastomeric ring 20 is compressed which forms a seal between the inside surface of the conductive tube of coaxial cable 70 and the contact 60 passing through the center of the tubular spacer 74, the plurality of seal stacks 55, the washer 30, and the annular base component 72. In this embodiment the diameter of the flexible rigid component 10 is less than the internal diameter of the conductive tube of coaxial cable 70. The arms 11 of the flexible rigid component 10 offer stiff resistance to the elastomeric ring 20 thereby enabling elastomeric component 20 to shorten axially and thus expand radially to engage the two surfaces enclosing the annular space. Effectively in a low pressure environment the elastomeric component becomes a low-pressure seal and the flexible rigid component an anti-extrusion ring.

A high pressure and temperature drilling environment is generally found in deeper wells where the temperature and pressure increases with the depth of the drilling component in the well. Such extreme conditions require more robust seal designs and materials. FIG. 13 depicts the current seal system in such an extreme environment wherein the effect of the high pressure and temperature causes the plurality of seal stacks 55 to sandwich together. The annular base component 72 engages the inside surface of the conductive tube of coaxially cable 70 thus maintaining its position within the coaxial cable. A washer 30 is placed on top of the annular base part 72 which increases the stiff resistance to the pressure load of the seal stacks 55 from above. As pressure and temperature increase the elastomeric component becomes less of a low-pressure seal and more of a high-pressure load ring. The flexible rigid component 10 becomes less rigid and more flexible under higher temperatures and pressures. In effect, the flexible rigid component becomes a high-pressure seal. The extreme pressures and temperatures cause the seal stacks 55 to shorten axially wherein the elastomeric component 20 fills the trough causing the arms 11 to bow and thus expand radially outwardly to engage the surface of the conductive tube of coaxial cable 70 and inwardly to engage the surface of the contact 60 thus forming a seal. The elastomeric components also still engage the surface of the conductive tube and the contact increasing seal robustness. It can be seen from the description and appended drawings that under extreme temperature and pressure conditions that if the elastomeric component didn't have a greater volume than that of the trough in the flexible rigid component, then it would fill the trough without causing the flexible rigid component to engage the surrounding side walls and form a seal. The elastomeric component would simply fill in the trough and conform its shape to that of the trough.

In such a difficult setting to form a seal, not only does general shape and design become a key component to success but also choice of materials. Accordingly the flexible rigid component must exhibit physical and mechanical properties that change only moderately under extreme temperature environs allowing some flexibility at the extreme end of its service temperature use. The materials should have high temperature resistance and high sheer strength in order to maintain its basic shape without significant creeping under high pressures and temperatures. Therefore the flexible rigid components are preferably constructed out of a thermoplastic material, such as polyether ether ketone or polyether ketone ketone. Such plastics can be fiber reinforced, glass gilled or carbon filled grades. Other alternative materials include liquid crystal polymers, polyamide, fiber-reinforced composite materials, and electrically insulated metals.

The term elastomer should be understood to represent a material that has relatively no yield point and generally has a low glass transition temperature such as an amorphous polymer that is soft and pliable at room temperature. Preferably the elastomeric component is made of a chemical resistant material that also exhibits temperature resistance. Thus the elastomeric component can be made of materials that are classified according to ASTM D standard 1418 such as FFKM, FKM, NBR, XNBR and HNBR type components with the most preferable material being FFKM or FKM type. FFKM materials are generally known as perfluoroelastomers whereas FKM materials are known as fluoroelastomers.

Kalrez®, a registered trademark of E.I. DU PONT DE NEMOURS AND COMPANY is one such example of a perfluoroelastomer. Simriz, a copolymer of tetrafluoroethylene and perfluorovinyl ether is another example of a perfluoroelastomer. Another preferable perfluoroelastomer is Chemraz®, a registered trademark of Greene, Tweed Company.

Some examples of fluoroelastomers, sometimes also referred to as fluorocarbons, are Aflas®, a registered trademark of Asahi Glass Co., Ltd., and Viton®, a registered trademark of DUPONT DOW ELASTOMERS L.L.C. Aflas® is a copolymer of tetrafluoroethylene and propylene whereas Viton® is a vinylidene fluoride and hexafluoropropylene copolymer. NBR is generally known as acrylonitrile Butadiene, HNBR as a highly saturated nitrile, and XNBR as a carboxylated Nitrile.

Another material property under consideration in choosing a suitable elastomer material is the hardness as measured on a Shore A scale. Preferably the hardness is at least 70 on a Shore A scale though in some instances a Shore A 90 hardness might be preferable. Increasing the hardness of the elastomeric material decreases its tendency to flow under high pressures thus decrease its likelihood of extrusion. For instance, the first and second seal stack 53, 52 could be an elastomeric material with a Shore A hardness of at least 90 with the third and fourth seal stack 51, 50 at least a 70 on a Shore A hardness scale. Such a configuration would allow the seal stacks 51, 50 to perform better under lower pressures with the seal stacks 52, 53 better suited for higher pressures and temperatures.

Many types of data sources are important to management of a drilling operation. These include parameters such as hole temperature and pressure, salinity and pH of the drilling mud, magnetic declination and horizontal declination of the bottom-hole assembly, seismic look-ahead information about the surrounding formation, electrical resistivity of the information, pore pressure of the formation, gamma ray characterization of the formation, and so forth. The high data rate provided by the present invention provides the opportunity for better use of this type of data and for the development of gathering and use of other types of data not presently available.

It is therefore intended that the foregoing detailed description be regarded as illustrative rather than limiting, and that it be understood that it is the following claims, including all equivalents, that are intended to define the spirit and scope of this invention.

What is claimed is:

1. An internal coaxial cable seal system, comprising:

a coaxial cable, the coaxial cable comprising a conductive tube and a conductive core within it;

an annular base component comprising a means for engaging the internal diameter of the conductive tube and lying within the conductive tube;

a washer lying adjacent the base component;

a seal stack adjacent the washer comprising at least one annular flexible rigid component having a trough comprising a first volume adjacent at least one annular elastomeric component comprising a second volume, the first volume being less than the second volume; wherein the coaxial cable seal system seals against the conductive tube and an electrically isolated contact comprising a wire lying coaxially within the seal system.

2. The seal system of claim 1 wherein the coaxial cable is contained within a downhole tool comprising tool joints.

3. The seal system of claim 1 wherein the annular base component has ridges on the outer diameter.

4. The seal system of claim 1 includes a tubular spacer, the tubular spacer having a first end and a second end, the first end having a diameter that is less than the internal diameter of the conductive tube, the tubular spacer lying on top of the seal stack such that the seal stack is located within the conductive tube, the contact passing through the tubular spacer, the seal stack, the washer, and the base component.

5. The seal system of claim 1 comprising more than one seal stack lying serially on top of each other within the conductive tube of the coaxial cable.

6. The seal system of claim 5 comprising a first, a second, a third, and a fourth seal stack lying serially on top of each other, the first seal stack lying adjacent the washer the second, third, and fourth rigid component lying on the elastomeric component of the preceding seal stack.

7. The seal system of claim 1 wherein the elastomeric component comprises an o-ring.

8. The seal system of claim 1 wherein the elastomeric component comprises an x-ring.

9. The seal system of claim 1 wherein the elastomeric component has a first side, the first side is shaped to fill in the trough of the rigid component, the first side of the elastomeric component lying within the trough of the rigid component.

10. The seal system of claim 1 wherein the elastomeric component comprises elastomeric material having a minimum hardness of 70 on a Shore A hardness scale.

11. The seal system of claim 4 wherein the elastomeric components of the first and second stacks comprise an elastomeric material having a minimum hardness of 90 on a Shore A hardness scale.

12. The elastomeric material as in claim 10 or 11 is chosen from the group consisting of perfluoroelastomers, fluoroelastomers, acrylonitrile butadiene, highly saturated nitrile elastomer compounds, or carboxylated nitrile compounds.

13. The elastomeric material as in claim 10 or 11 is chosen from the group consisting of FKM, FFKM, XNBR. HNBR, and NBR according to the ASTM-D standard 1418.

14. The seal system of claim 1 wherein the elastomeric component is a chemical resistant material.

15. The seal system of claim 1 wherein the trough of the rigid component is a deep groove wherein the groove depth is over half the height of the rigid component.

16. The seal system of claim 1 wherein the trough of the rigid component is a shallow groove wherein the groove depth is less than half the height of the rigid component.

17. The seal system of claim 1 wherein the trough of the rigid component forms a v-shape.

18. The seal system of claim 1 wherein the trough of the rigid component forms a generally v-shape with a concave bottom.

19. The seal system of claim 1 wherein the trough of the rigid component forms a half circle bottom.

20. The seal system of claim 1 wherein a first and a second arm of the rigid component have an arcuate sidewall, each arm forming the trough.

21. The seal system of claim 1 wherein the rigid component comprises a first and a second rigid ring, each rigid ring having a base, the base of the first rigid ring is substantially flat, the first rigid ring having a top that forms a complimentary angle with the base of the second rigid ring, the second rigid ring having a trough comprising a first volume adjacent at least one annular elastomeric component comprising a second volume, the first volume being less than the second volume.

22. The seal system of claim 21 wherein the trough of the second rigid ring is a deep groove wherein the groove depth is over half the height of the rigid component.

23. The seal system of claim 21 wherein the trough of the second rigid ring is a shallow groove wherein the groove depth is less than half the height of the rigid component.

24. The seal system of claim 21 wherein the trough of the second rigid ring forms a v-shape.

25. The seal system of claim 21 wherein the trough of the second rigid ring forms a generally v-shape with a concave bottom.

26. The seal system of claim 21 wherein the trough of the second rigid ring forms a half circle bottom.

27. The seal system of claim 21 wherein a first and a second arm of the rigid component have an arcuate sidewall, each arm forming the trough.

28. The seal system of claim 1 wherein the rigid component is made of polyether ether ketone.

29. The seal system of claim 21 wherein the first rigid ring is made of polyether ether ketone.

30. The seal system of claim 21 wherein the second rigid ring is made of metal filled Teflon.

31. The seal system of claim 1 wherein the elastomeric component is placed within a trough formed on one side of the rigid component.

32. The seal system of claim 1 wherein the washer is made of ceramic.

33. The washer of claim 31 wherein the ceramic is selected from the group consisting of cemented tungsten carbide, alumina, silicon carbide, silicone nitride, and polycrystalline diamond.

34. The seal system of claim 1 wherein the washer is made of a plastic material.

35. The washer of claim 33 wherein the plastic consists of polyether ether ketone, glass filled polyether ether ketone, carbon filled polyether ether ketone, polyether ketone ketone, glass filled polyether ketone ketone, mineral filled polyether ketone ketone, and carbon filled polyether ketone ketone.

36. The seal system of claim 1 wherein the washer is made of garolite.

* * * * *